US006129017A

United States Patent [19]

Mohrmann et al.

[11] Patent Number: 6,129,017

[45] Date of Patent: Oct. 10, 2000

[54] CYLINDER FOR ROTARY PRESS

[75] Inventors: Hans Dierk Mohrmann, Kürnach; Rainer Wieland, Würzburg, both of Germany

[73] Assignee: Koenig & Bauer Aktiengesellschaft, Wurzburg, Germany

[21] Appl. No.: 09/319,949

[22] PCT Filed: Dec. 19, 1997

[86] PCT No.: PCT/DE97/02985

§ 371 Date: Aug. 10, 1999

§ 102(e) Date: Aug. 10, 1999

[87] PCT Pub. No.: WO98/28142

PCT Pub. Date: Jul. 2, 1998

[30] Foreign Application Priority Data

Dec. 20, 1996 [DE] Germany ..... 196 53 44

[51] Int. Cl.[7] ..... B41F 13/10

[52] U.S. Cl. ..... 101/376; 492/4; 492/28; 492/33; 492/5

[58] Field of Search ..... 101/376, 375, 101/383, 389.1, 217; 492/4, 5, 28, 30, 33, 34

[56] References Cited

U.S. PATENT DOCUMENTS

| | | | |
|---|---|---|---|
| 3,253,323 | 5/1966 | Saueressig | 101/376 |
| 3,968,747 | 7/1976 | Johnson | 101/376 |
| 4,129,074 | 12/1978 | Beaver et al. | 101/376 |
| 4,327,467 | 5/1982 | Quaint | 495/4 |
| 4,425,695 | 1/1984 | Tokuno | 492/33 |
| 4,742,597 | 5/1988 | LaFlamme | 492/33 |
| 5,257,965 | 11/1993 | Fuchs et al. | 492/5 |
| 5,507,226 | 4/1996 | Burk et al. | 492/33 |
| 5,522,316 | 6/1996 | Behnke et al. | 101/376 |
| 5,553,806 | 9/1996 | Lucas | 492/33 |
| 5,819,657 | 10/1998 | Rossini | 101/376 |

FOREIGN PATENT DOCUMENTS

PS 875205 4/1953 Germany .

*Primary Examiner*—Eugene Eickholt
*Attorney, Agent, or Firm*—Jones, Tullar & Cooper, PC

[57] ABSTRACT

A cylinder for a rotary printing press can be changed between two operating modes. In a first one of these operating modes the cylinder's surface is divided into many sections. In the second operating mode, the cylinder has a functionally continuous surface area.

24 Claims, 11 Drawing Sheets

CYLINDER FOR ROTARY PRESS

FIELD OF THE INVENTION

The invention relates to a cylinder for a rotary printing press, a method for dividing a cylinder and a method for producing a cylinder.

DESCRIPTION OF THE INVENTION

DE-PS 875 205 describes a cylinder with several individual sleeve-like cylinders arranged on a common shaft.

It is disadvantageous in connection with this cylinder that the individual cylinders cannot form an uninterrupted surface.

DE 27 45 086 A1 describes an ink duct cylinder for containing different inks in adjacent areas, whose barrels have circulating separating grooves. These separating grooves can be filled with a flexible tape.

SUMMARY OF THE INVENTION

It is the object of the invention to create a cylinder.

The advantages which can be attained by means of the invention reside in particular in that a barrel of a cylinder can be selectively divided into sections. In this way it is possible, for example, to adapt the cylinder to a plurality of plates placed at a distance next to each other, without it being necessary to change cylinders. Accumulations of ink in the area of the spaces between the plates are prevented. Printing disruptions are reduced by this and the print quality is increased.

If the division is obtained by means of a constriction of a continuous surface area, the latter sealingly covers the operating means for creating this constriction, so that no ink, for example, can penetrate into the interior of the cylinder.

The cylinders can be remotely controlled, i.e. they can also be adjusted while the press is running, for example.

The cylinder in accordance with the invention for a rotary printing press is represented in the drawings and will be described in greater detail in what follows.

BRIEF DESCRIPTION OF THE DRAWINGS

Shown are in.

DESCRIPTION OF THE PREFERRED EMBODIMENT

Figures 1, 2, 3, 4:
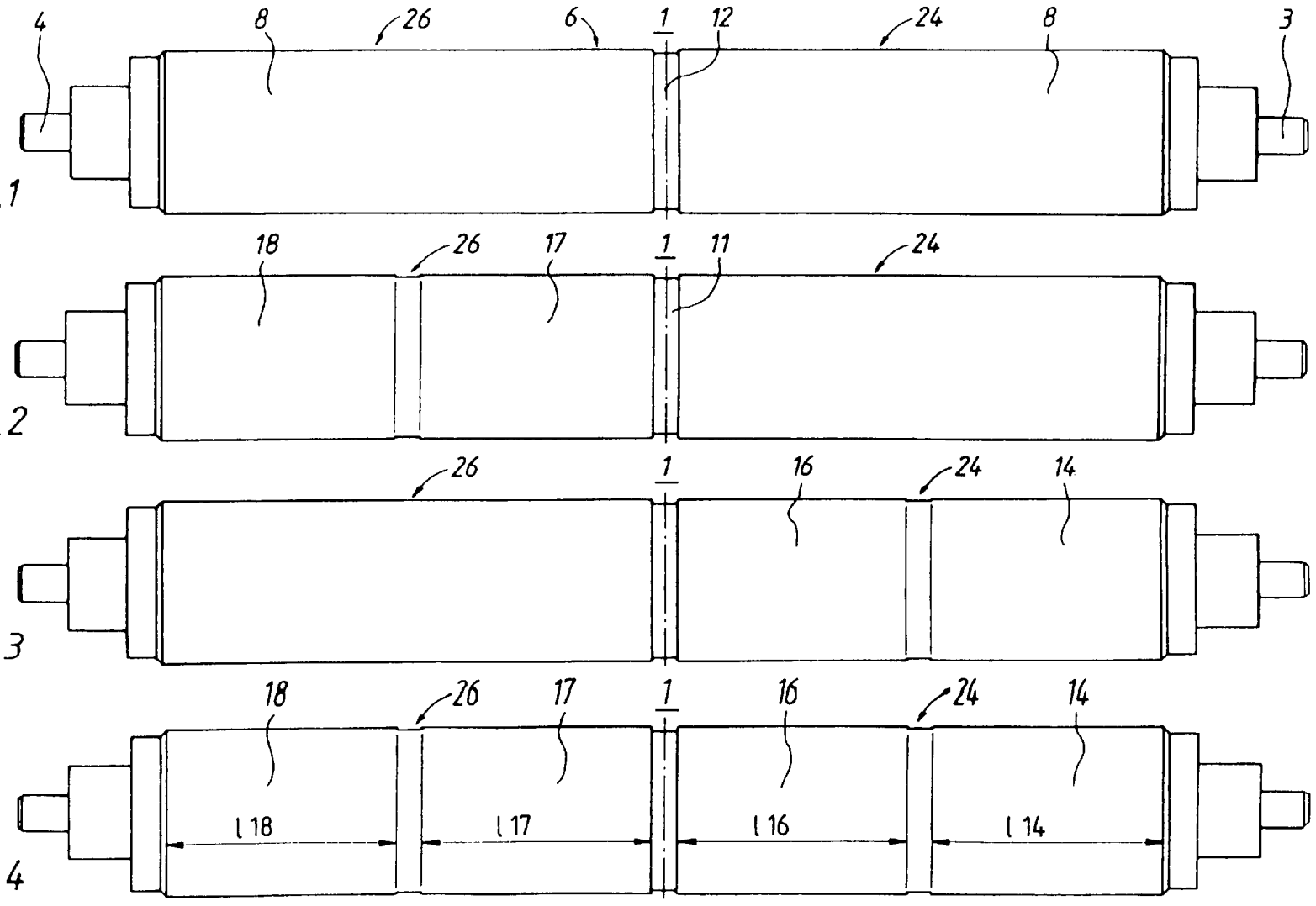
FIGS. 1 to 4, schematic representations of a first type of a cylinder in various operating positions.

A cylinder 1 essentially has two journals 3, 4 and a barrel 6. The journals 3, 4 are stationary fastened, for example in relation to lateral frames, not represented, and the barrel 6 is rotatably seated on the journals 3, 4. In the present exemplary embodiments, a surface area 8 of the barrel 6 is provided with a circulating groove 11 in its center, so that the cylinder 1 is designed approximately axis-symmetrically in respect to a center line 12 of this groove 11. This cylinder 1 preferably is an ink or moisture application cylinder of a rotary printing press cooperating with a plate cylinder.

The barrel 6 of this cylinder 1 is coated, for example, with a rubber-elastic cover 13, for example caoutchouc or an elastomer. Viewed in the axial direction, the plate cylinder is provided with a plurality of plates placed next to each other. For example, two "half width", or one "half width" and two "quarter width", or four "quarter width" plates can be selectively placed on this plate cylinder.

The cylinder 1 is adaptable in accordance with a selected coverage of the plate cylinder, i.e. the surface area 8 of the barrel 6 can be divided into individual sections 14, 16, 17, 18 with preferably identical invariable diameters.

Thus, in the axial direction the barrel 6 of the cylinder 1 has a selectable number of cylindrical sections 14, 16, 17, 18, whose length 214, 216, 217, 218 is matched to the width of the associated printing plate.

FIG. 1 represents the cylinder 1, which is divided into two halves 24, 26 by the grove 11, in an initial position.

FIG. 2 shows the cylinder 1, whose left half 26 of the barrel 6 has two sections 17,18, in a second position.

In FIG. 3, the cylinder 1 is in a third position, wherein the right half 24 of the barrel 6 is divided into two sections 14, 16.

In the fourth position of the cylinder 1 in FIG. 4, the right half 24 and the left half 26 of the barrel 6 are respectively divided into two sections 14, 16 and 17, 18.

In place of the division represented, another number and arrangement (for example asymmetric) of the sections 14, 16, 17, 18 is also possible.

In the following descriptions respectively only one half 26 of the cylinder 1 is described and represented for the sake of simplicity. In relation to an axis of rotation of the cylinder 1, the cylinder 1 is represented in the non-actuated initial position, i.e. with an undivided barrel 6, in the upper portion of respectively one drawing figure, and in the lower portion the cylinder 1 is represented in the actuated state, i.e. with the barrel 6 divided.

Figure 5:
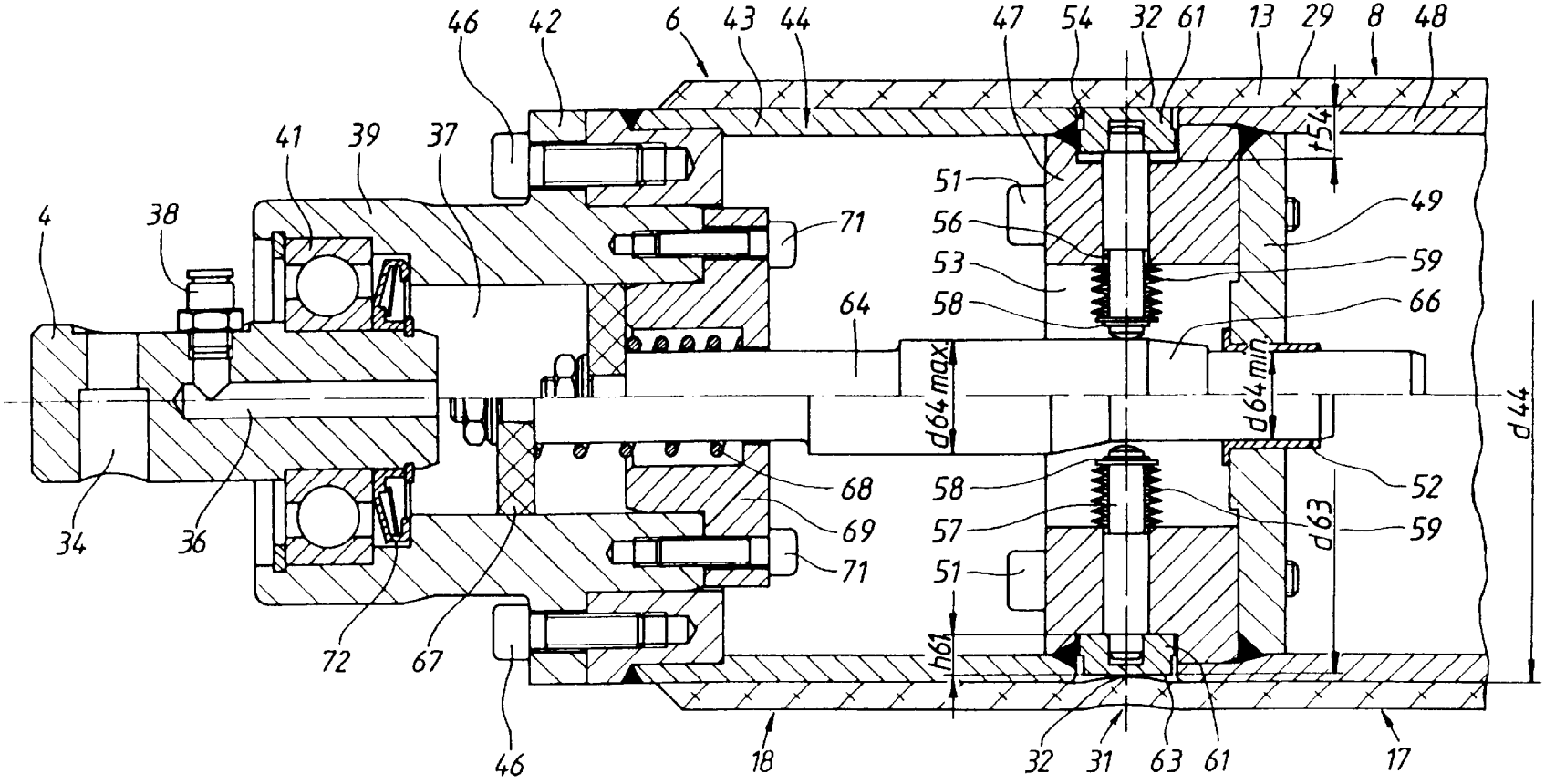
FIG. 5, a schematic longitudinal section through a first exemplary embodiment of a cylinder.

The barrel 6 of the divisible cylinder 1 is provided with an uninterrupted surface area 29 in FIG. 5. In this case a reversible constriction 31 is generated for dividing this barrel 6 into two sections 17, 18 by an actuating means located in the interior of the cylinder 1. Forces which pull an inside 32 of the cover 13 radially inward are generated by these controllable actuating means.

Figure 6:
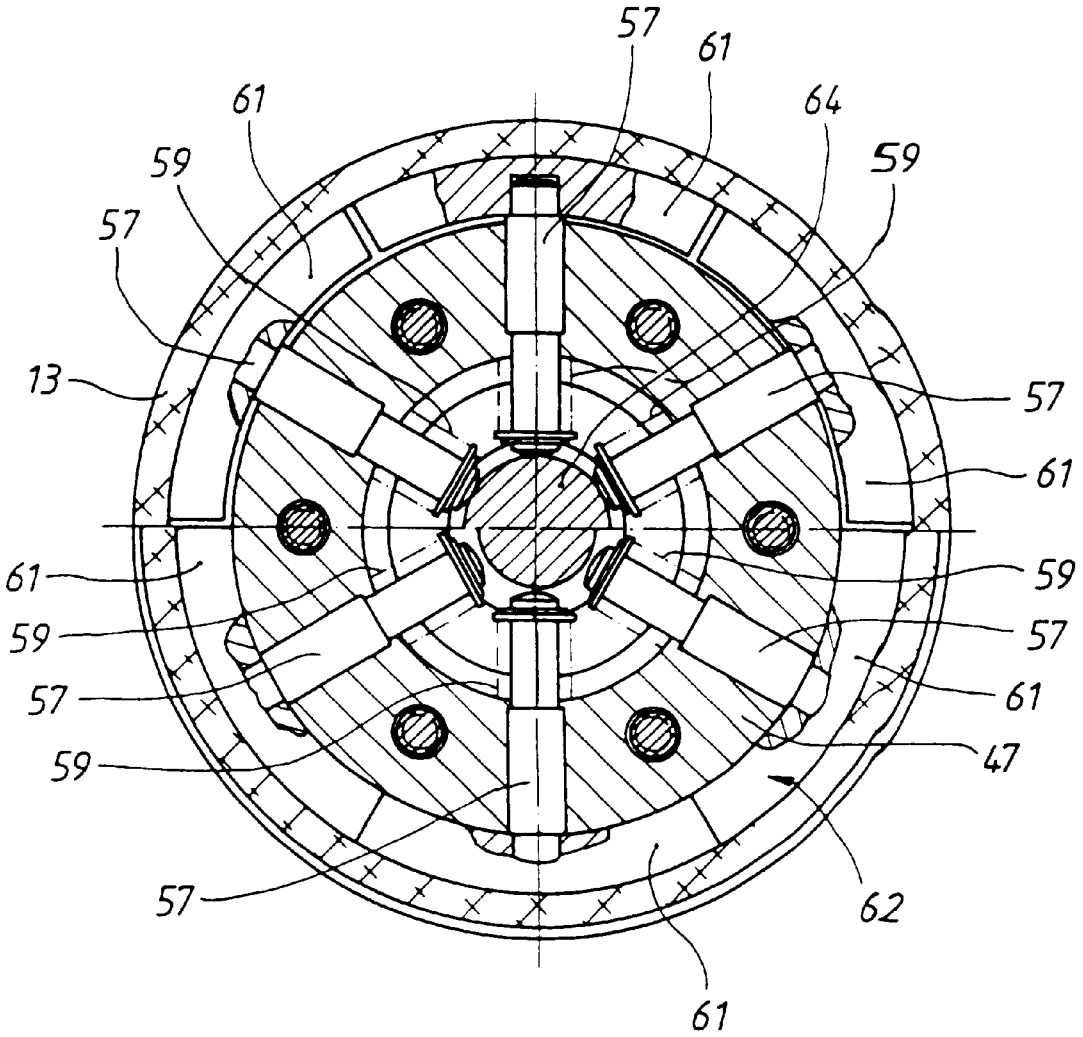
FIG. 6, a schematic cross section through a cylinder in accordance with FIG. 5.

In a first exemplary embodiment (FIG. 5, FIG. 6) of the cylinder 1, a journal 4 is provided with a through-bore 34 in the radial direction. This through-bore 34 is used for fastening the journal 4 by means of a threaded screw, for example on a cylinder bearing on a lateral frame. The journal 4 has a centered blind bore 36 in the axial direction, whose open end terminates in a chamber 37 in the interior of the cylinder 1. A connector 38 for supplying a pressure medium, for example compressed air, which terminates in the blind bore 36 in the radial direction, is provided at the opposite end of this blind bore 36. A sleeve 39 is seated on the journal 4 and is rotatable by means of a rolling bearing 41. This sleeve 39 has a flange 42, which is connected at the front by means of threaded screws 46 with a first partial element 43 of a support tube 44 for the cover 13 of the cylinder 1. This first partial element 43 is fastened, spaced apart by means of a connecting element 47, on a second partial element 48 of the support tube 44. A disk 49, which has axially extending threaded bores arranged on a partial circle, has been welded into the second partial element 48. The connecting element 47 is screwed to this disk 49 by means of threaded screws 51. This disk 49 is furthermore provided with a slide bearing 52, which is arranged centered.

A circulating groove 54, which has an interior bore 53, has been cut into the connecting element 47. This groove 54 and the interior bore 53 are connected by means of radially arranged bores 56. A plunger 57 is seated, radially displaceable, in each of these bores 56. Each plunger 57 is provided with a retaining ring 58 at its inward pointing end. Plate springs 59 are arranged on each plunger 57 between this retaining ring 58 and a wall of the interior bore 53, so that an inward force acts on the plungers 57 because of the plate springs 59. A segment 61 of a support ring 62 is respectively firmly fastened at an outward located end of the plungers 57. A height h61 of a segment 61 is less than a depth t54 of the groove 54 in the support tube 44 and the connecting element 47. The cover 13 of the cylinder 1 is fastened on these segments 61, for example vulcanized or glued to them.

In the retracted state of the plungers 57, the segments 61 adjoin each other without spacing and rest on the bottom of the groove 54. With the plungers 57 retracted, a diameter d63 of exterior faces 63 of the segments 61 of the support ring 62 is therefore less than an exterior diameter d44 of the support tube 44. With the plungers 57 retracted, a constriction 31 in the cover 13 is formed in this way in the area of the segments 61.

With the plungers 57 extended, the diameter d63' formed by the exterior faces 63 of the segments 61 is equal to the exterior diameter d44 of the support tube 44.

A piston rod 64 is provided for actuating the plungers 57 and has, for example, a left-rising cone 66 in the area of the plungers 57. This cone 66 connects an area of the piston rod 64 of a first, narrow diameter d64min. with an area of the piston rod 64 with an area of the piston rod 64 of a second, large diameter d64max. The plungers 57 are pushed radially outward by the axial displacement of the piston rod 64 in the direction toward the center of the cylinder 1.

A first end of the piston rod 64 is seated in the slide bearing 52 of the disk 49. A disk 67, used as a piston, has been screwed to a second end of the piston rod 64. A compression spring 68 has been pushed on the piston rod 64 between this disk 67 and a flange 69. The flange 69 is provided with a shoulder, which extends on a side facing away from the journal 4 into the interior bore of the sleeve 39. The flange 69 is screwed to a front face of the sleeve 39 by means of threaded screws 71. Thus, the compression spring 68 is supported between the flange 69 and the disk 67 and generates a force in the direction toward the journal 4 acting on the piston rod 64.

A seal 72 is arranged on a shoulder in front of the slide bearing 41 on a side of the interior bore of the sleeve 39 facing toward the journal 4. This seal 72 seals the stationary journal 4 at the front face against the rotating sleeve 39. In this way the interior bore of the sleeve 39 constitutes the chamber 37, which can be selectively charged with a pressure medium and actuates the piston rod 64.

If the chamber 37 is now charged with a pressure medium, the piston rod 64 moves axially in the direction toward the center of the cylinder, and the plungers 57 move from the narrow diameter d64min. to the large diameter d64max. The constriction 31 of the cover 13 is relaxed by this and a continuous surface area 8 results.

If the chamber 37 is relieved of pressure, the compression spring 68 pushes the piston rod 64 in the direction toward the journal 4, and the plungers 57 move from the large diameter d64max. to the narrow diameter d64min. The plungers 57, and therefore the segments 61 pull the cover 31 radially inward, by which the constriction 31 of the cover 13 is achieved.

It is of course also possible to reverse the switched states, i.e. the constriction 31 is created by the charge with pressure means.

Actuation of the cylinder 1 takes place pneumatically, for example.

Figure 7:
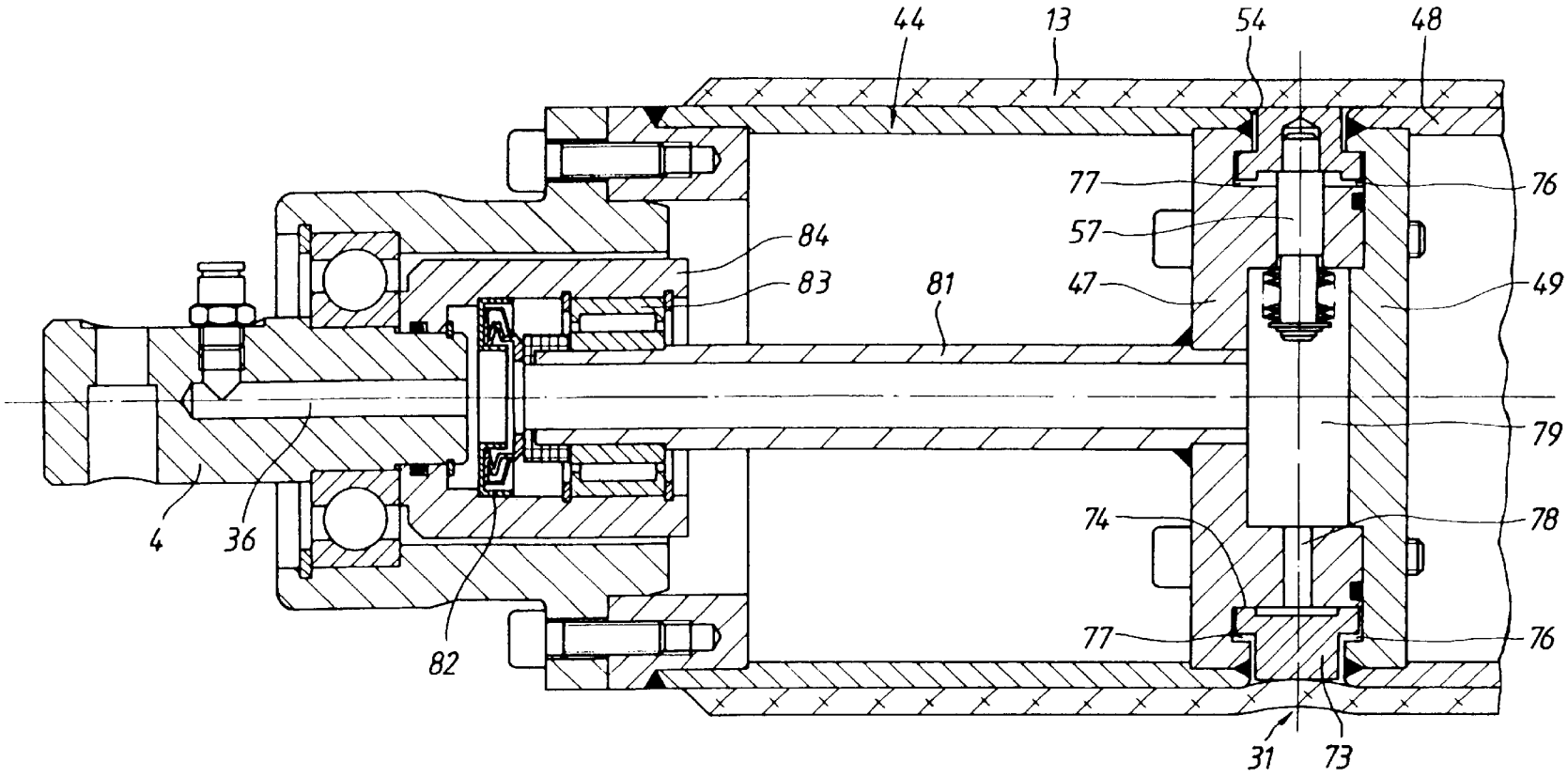
FIG. 7, a schematic longitudinal section through a second exemplary embodiment of a cylinder.
Figure 8:
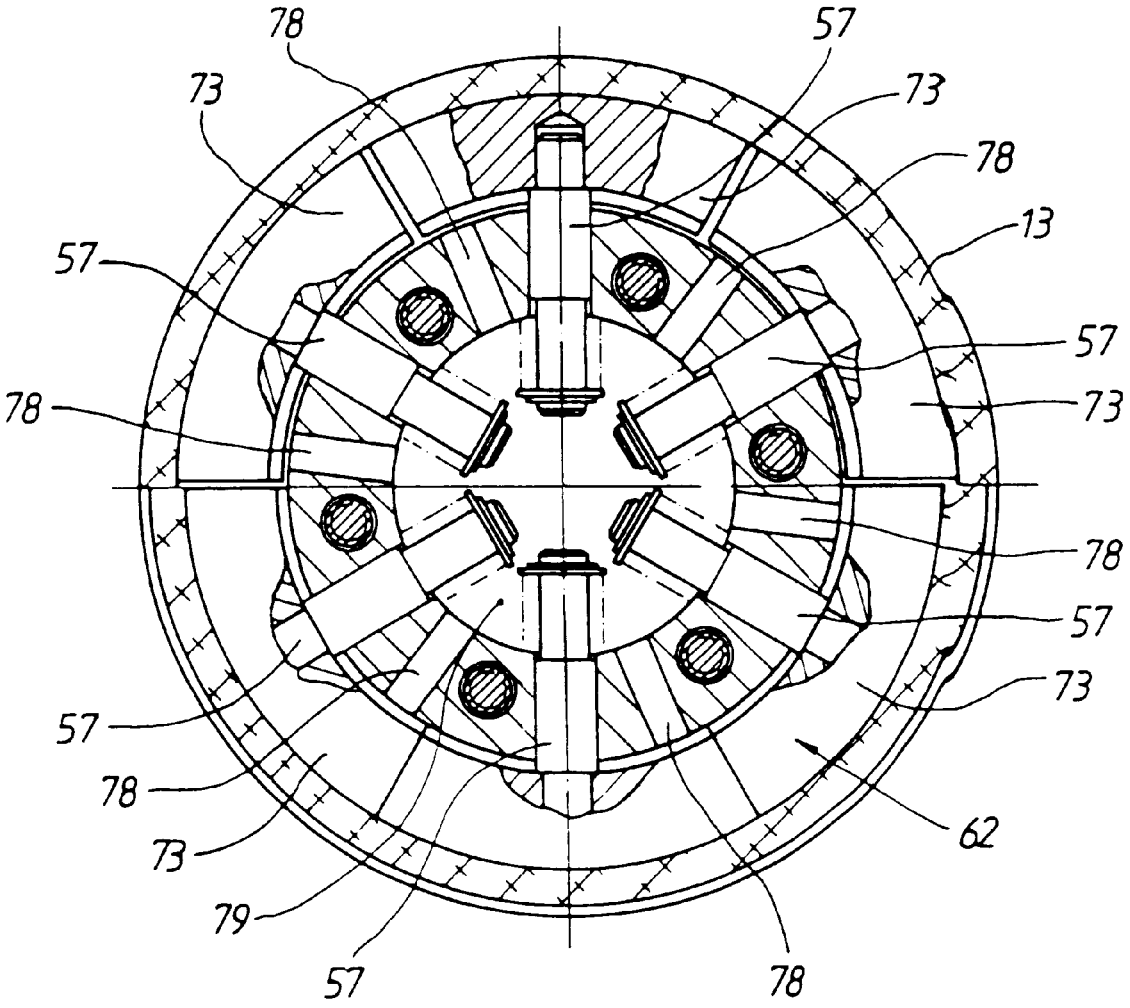
FIG. 8, a schematic cross section through a cylinder in accordance with FIG. 7.

In a second exemplary embodiment (FIG. 7, FIG. 8) of a first type of cylinders 1, the segments 73 are directly charged with a pressure medium and in this way pushed radially outward, so that the constriction 31 is relaxed and a continuous cover 13 is achieved.

If the segments 73 are relieved of pressure, the plungers 57, which are spring-loaded in accordance with the first exemplary embodiment, pull back the segments 73 and the cover 13 connected with them, so that a constriction 31 of the cover 13 is created.

The segments 73 and the associated groove 54 in the support tube 44 and the connecting element 47 are made hat-shaped in cross section with a lower rim and are matched to each other.

The lower rim of the segments 73 is used as a stop 74. This stop 74 is located in two grooves 76, 77, which have been cut into lateral faces of the groove 54 in the support tube 44 and limit a lift of the segments 73 toward the exterior, as well as toward the interior.

Bores 78, which radially extend from the chamber 79 as far as into the groove 54 of the support tube 44, have been cut into the connecting element 47. Together with the disk 49 of the second partial element 48, the interior bore 53 of the connecting element 47 forms a chamber 79. A first end of a feed tube 81 terminates in this chamber 79. A second end of this feed tube 81 is connected by means of a seal 82 with the blind bore 36 of the journal 4. The feed tube 81 is seated, rotatable in respect to the journal 4, by means of a rolling bearing 83 and of an adapter element 84.

If the chamber 79 is relieved of pressure, the segments 73 are retracted toward the interior by the plungers 57, and the cover 13 is provided with a constriction 31. If the chamber 79 is charged with a pressure medium, the segments 73 are pushed outward and the constriction 31 of the cover 13 is relaxed.

Figure 9:
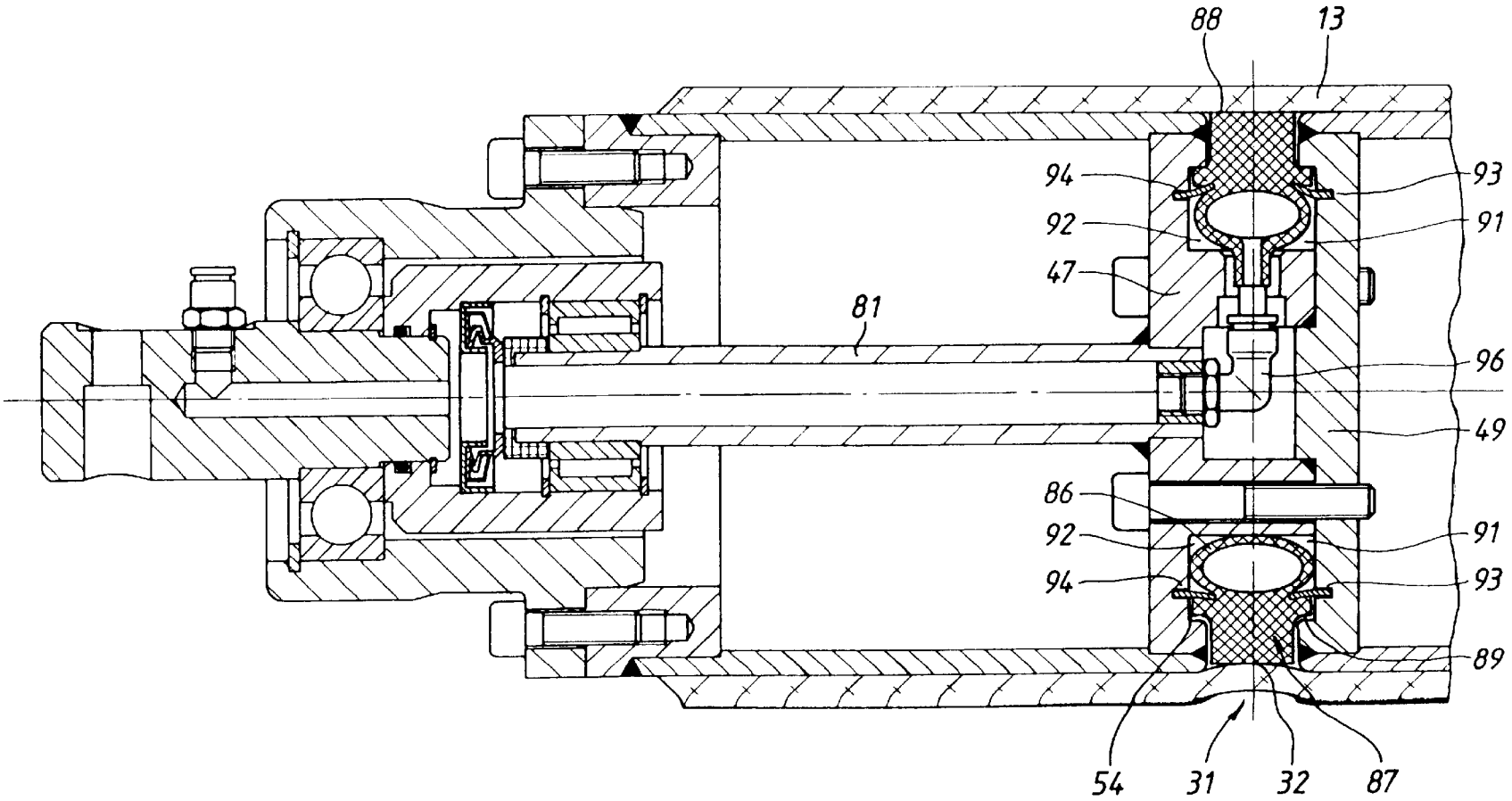
FIG. 9, a schematic longitudinal section through a third exemplary embodiment of a cylinder.

In a third exemplary embodiment (FIG. 9) of a cylinder 1, a ring-shaped hose 86 is provided in place of the segments 61, 73. Viewed in cross section, the hose 86 is provided with a hat-shaped ring 87. An exterior face 88 of the ring 87 is connected with an inside 32 of the cover 13 of the cylinder 1. A lower rim of the ring 87 is used as a stop 89, which limits the lift in the radial direction toward the exterior and cooperates with lateral grooves 91, 92 of the connecting element 47. Inward acting spring elements 93, 94, which are fastened in the groove 54 of the connecting element 47 and of the disk 49, act on both sides of an underside of the stop 42. This hose 86 is connected with the feed tube 81 by means of a connecting piece 96. This feed tube 81 and the associated pressure medium supply are embodied corresponding to the second exemplary embodiment.

If the hose 86 is free of pressure, the spring elements 93, 94 pull the hat-shaped ring 87, and thereby the cover 13, radially inward. The constriction 31 in the cover 13 is formed in this way.

To relax the constriction 31 of the cover 13, the hose 86 is charged with a pressure medium. By means of this the ring 87 is pushed radially outward until the lower stop 89 comes into contact with the lateral wall of the grooves 91, 92.

The constriction 31 can also be achieved in that the inside 32 of the cover 13 is indirectly or directly charged with a vacuum.

Figure 12:
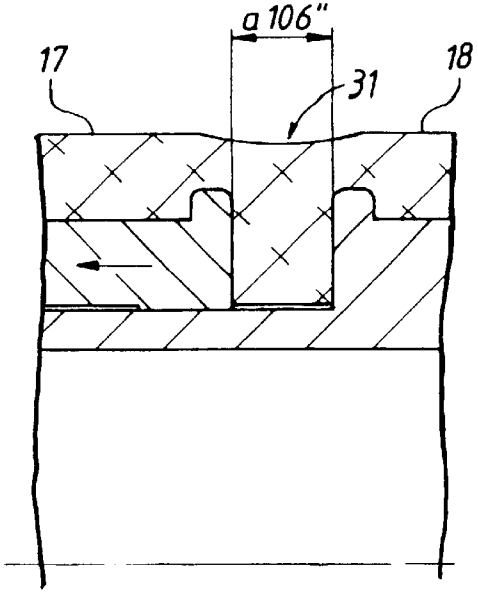
FIG. 12, a schematic longitudinal section through a fourth exemplary embodiment of a cylinder in the relaxed state with a constriction in accordance with FIG. 10.
Figure 11:
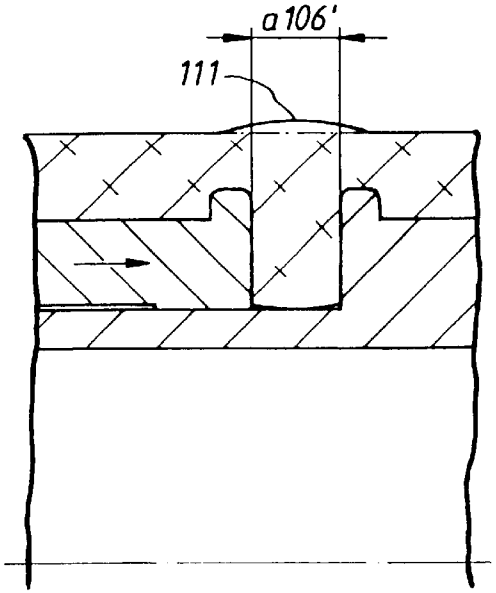
FIG. 11, a schematic longitudinal section through a fourth exemplary embodiment of a cylinder after compression.
Figure 10:
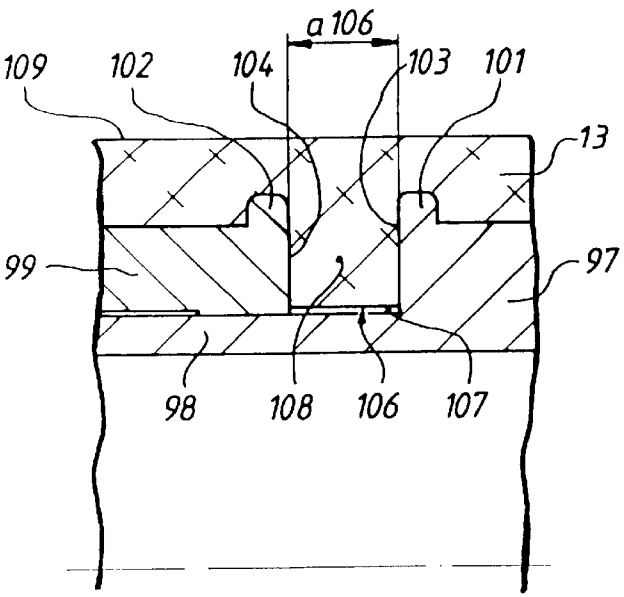
FIG. 10, a schematic longitudinal section through a fourth exemplary embodiment of a cylinder after coating.
Figure 13:
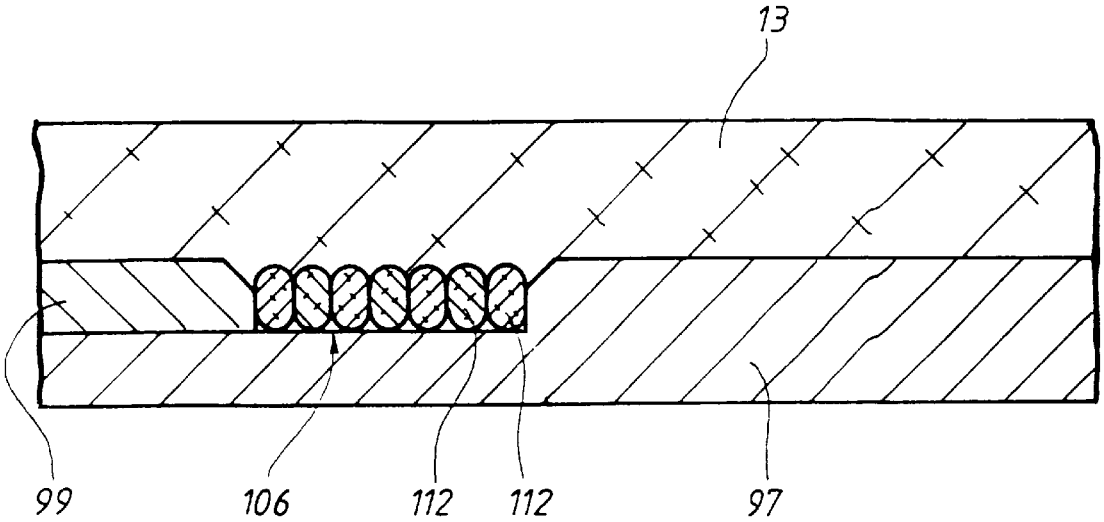
FIG. 13, a schematic cutaway portion of a fifth exemplary embodiment of a cylinder in the compressed state.

In a fourth exemplary embodiment (FIGS. 10 to 12), a support tube 97 is provided with a shoulder 98, on which a sleeve 99 is seated, displaceable in the axial direction of the cylinder 1. This sleeve 99 is fixed against twisting in the circumferential direction. The sleeve 99 and the support tube 97 are respectively provided with a collar 101, 102 at their facing ends. This collar 101, 102, which is greater in diameter in respect to the sleeve 99, or respectively the support tube 97, can be directly formed on them, for example, or can respectively consist of a disk seated on the shoulder 98 of the support tube 97.

The lateral faces 103, 104, seated oppositeof each other, of the two collars 101, 102 have an adjustable distance a106, for example a106=20 mm. To change this distance a106, an adjustment device, not represented, acts on the sleeve 99 and axially displaces the sleeve 99. This adjustment can be actuated, for example, by means of a threaded spindle, a work cylinder, which can be charged with a pressure medium, or an electric motor. In this way an adjustment of the sleeve 99 is also possible while the press is running.

To coat the sleeve 99 and the support tube 97 with a rubber-elastic cover 13, the sleeve 99 is moved into its position remote from the support tube 97 (FIG. 10), so that a groove 106, U-shaped in cross section, is formed between the two collars 101, 102, which are at the distance a106.

The rubber-elastic cover 13 is now firmly connected with the support of the sleeve 99 constituting the cover and the support tube, for example vulcanized or glued to them. This cover 13 also fills the groove 106 except for a narrow gap 107 on the groove bottom, i.e. the lateral faces 103, 104 of the groove 106 are firmly connected with the cover 13, while a gap 107 between the cover 13 and the support tube 107 remains on the bottom of the groove. It is also possible to provide no gap 107 at the groove bottom, wherein here, too, the cover 13 is not connected in the radial direction with the support 97, 99 in the area of the constriction 31. The cover 13 has a material accumulation 108 acting as a support element. This material accumulation 108 is embodied to be ring-shaped, pointing radially in the direction toward the interior of the cylinder 1, for example as a circumferential bead.

Following the application of the cover 13, the sleeve 99 is moved in the direction toward the support tube 97, i.e. the center of the cylinder, so that the distance a106 of the two lateral faces 103, 104 of the groove 106 is reduced, for example by 2 mm, to a distance a106', for example, a106'= 18 mm. Since the rubber-elastic material of the cover 13 is incompressible to a large extent, the material of the cover 13 is pushed radially outward, as well as inward. In this way the gap 107 on the groove bottom is reduced, while at the same time a circumferential, ring-shaped bead 111 (FIG. 11) is formed on the outside located surface area 109 of the rubber-elastic cover 13. This bead 111 is milled or ground off, for example, and the cover 13 is finished to a desired diameter. In this way a continuous, uninterrupted cover 13 with a continuous, even exterior diameter also results in the area of the groove 106.

To divide the cover 13 into cylinder-shaped sections 17, 18, the distance a106' of the lateral faces 103, 104 of the groove 106 is increased, for example by 1 mm, to the distance a106", by displacing the sleeve 99. Axial forces, which stretch the cover 13 in the axial direction, act on the cover 13 in the area of the groove 106, which cause a reduction of the diameter of the cover 13 in the area of the groove 106.

The deformation of the cover 13 for achieving a constriction 31 can be reversed.

Figure 14:
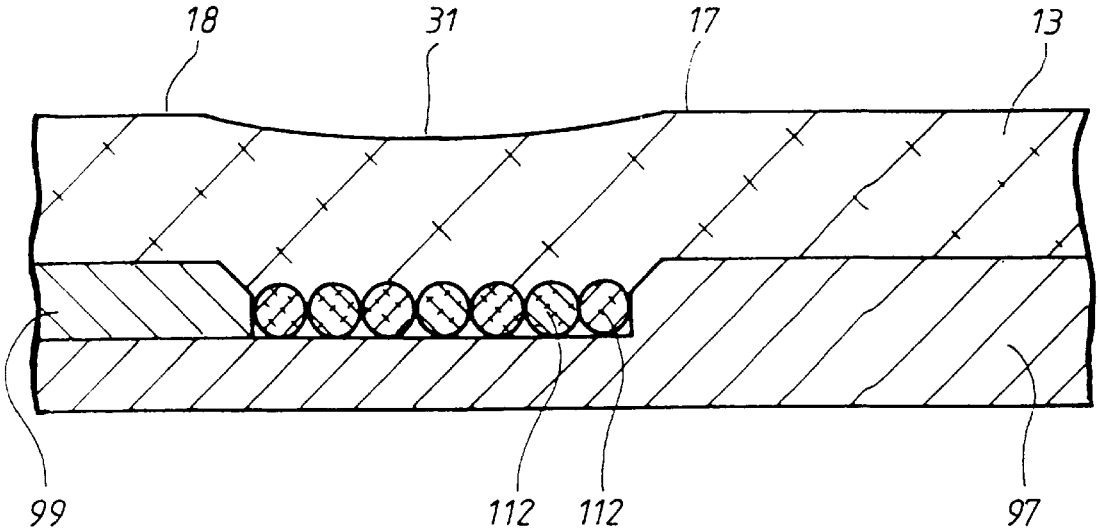
FIG. 14, a schematic cutaway portion of a cylinder in accordance with FIG. 13 in the relaxed state.

In accordance with the exemplary embodiments of FIG. 13 to FIG. 18, it is possible to arrange support elements in addition to the material accumulation 108 or in place of the material accumulation 108. For example, these support elements can be designed as O-rings 112 made of a rubber-elastic material (FIG. 3, FIG. 14).

Figure 15:
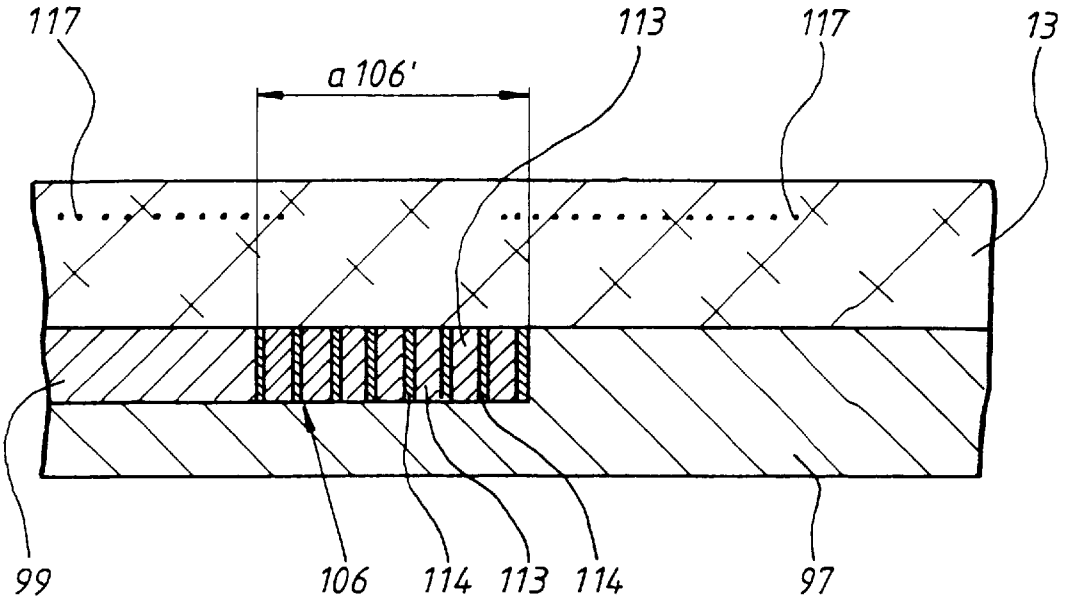
FIG. 15, a schematic cutaway portion of a sixth exemplary embodiment of a cylinder in the relaxed state.
Figure 16:
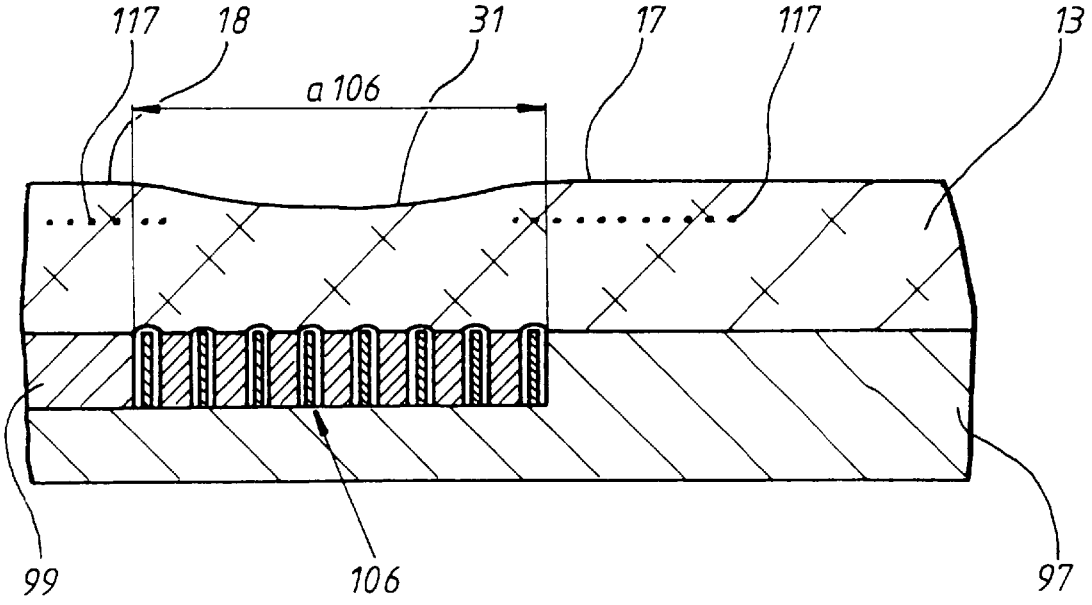
FIG. 16, a schematic cutaway portion of a cylinder in accordance with FIG. 15 in the stretched state.
Figure 17:
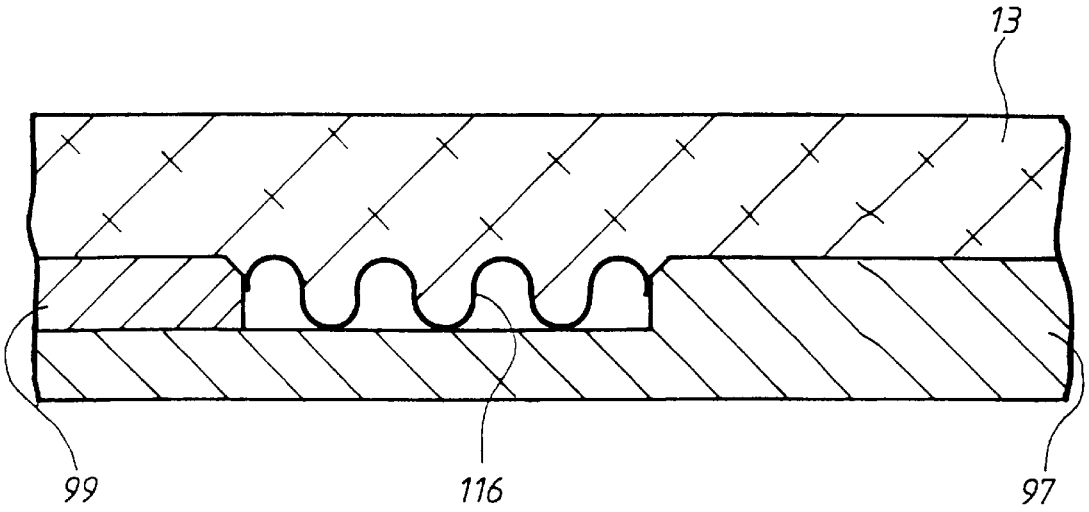
FIG. 17, a schematic cutaway portion of a seventh exemplary embodiment in the compressed state.
Figure 18:
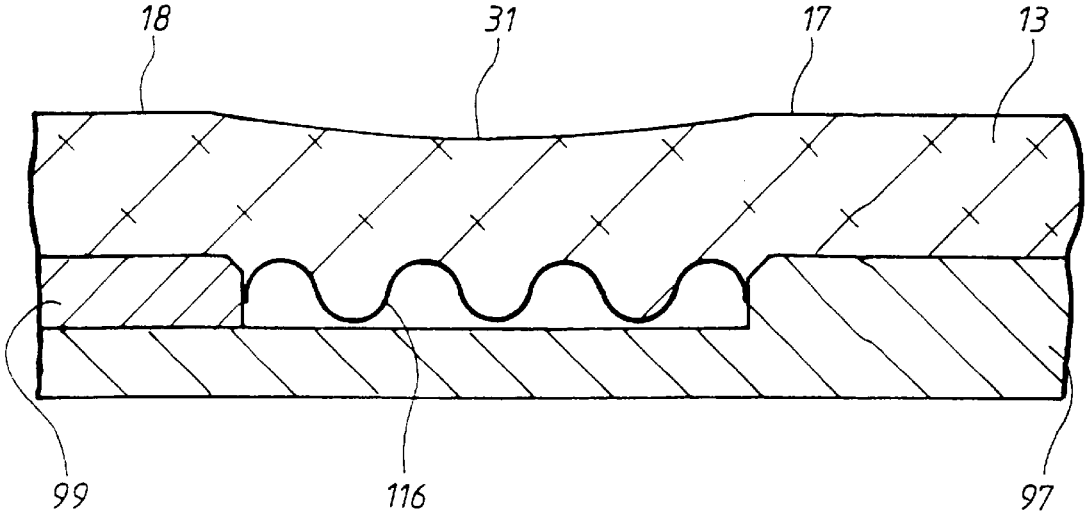
FIG. 18, a schematic cutaway portion of a cylinder in accordance with FIG. 17 in the relaxed state.

It is also possible to arrange alternating rings 113 (for example of steel) and disks 114 of lesser thickness, for example of plastic (Teflon, Viton) as support elements in the groove 106 FIG. 15, FIG. 16). The disks 114 and rings 113 can be axially moved in the groove 106. The rings 113 are preferably connected with the inside of the cover 13, while the disks 114 are not connected with the cover 13. The application and finishing of the cover 13 takes place with the rings 113, 114 pushed together in accordance with FIG. 15. The constriction 31 in FIG. 16 is provided by pulling the sleeve 99 to a size a106, i.e. vulcanizing and processing at a105' and pulling to a106. In principle, the production and obtaining the constriction 31 is also possible in the way represented in the example of FIG. 15, FIG. 16.

In a further exemplary embodiment (FIG. 17, FIG. 18), a so-called corrugated pipe 116 is used as support element. This corrugated pipe 116 is connected with the inside of the cover 13 and can be moved in relation to the groove bottom.

Figure 19:
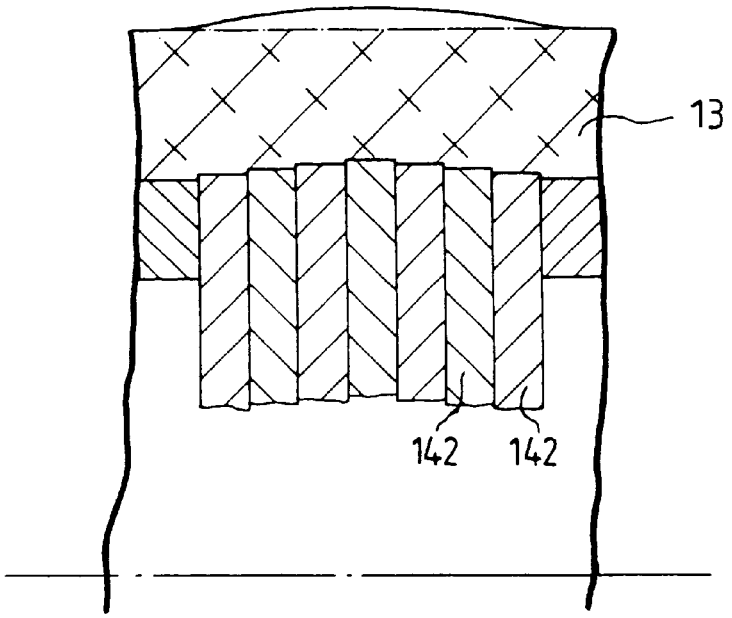
FIG. 19, a schematic cutaway portion of an eighth exemplary embodiment of a cylinder in an arched state.
Figure 20:
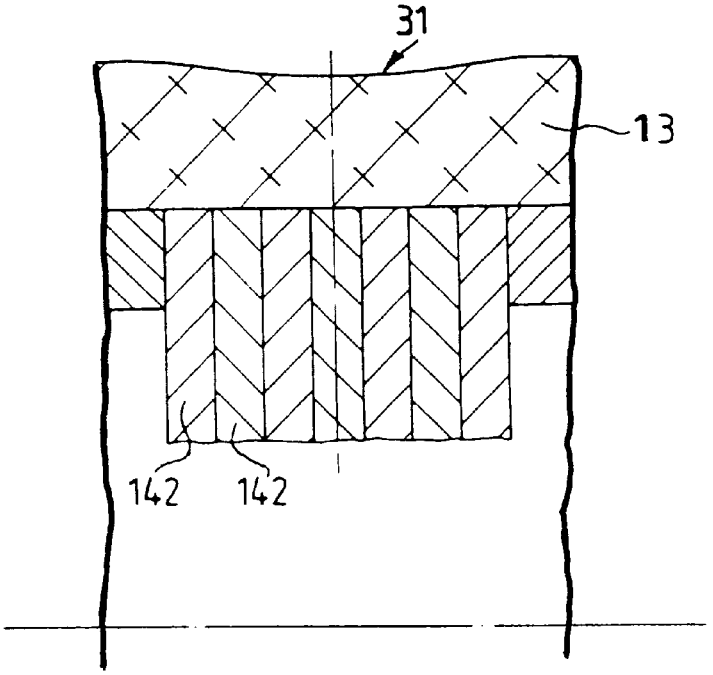
FIG. 20, a schematic cutaway portion of a cylinder in accordance with FIG. 19 with a constriction.

In an eighth exemplary embodiment, radial forces are generated on the inside of the cover 13 by means of the segment 61 similar to the one in FIG. 5. A plurality of disk-shaped segments 142 are arranged in FIGS. 19 and 20 in the axial direction of the cylinder 1. These segments 142 are connected with the inside of the cover 13 and are radially movable. The radial movement of the segments 142 is of different size, so that generating curves constituted by the surface areas of the segments 142 can approximately have the mirrored form of the constriction 31. The segments 142 can be movable together, but with different lift, or independently of each other, or in groups.

It is also advantageous to provide the cover 13 with a reinforcement 117, for example made of a steel mesh (FIG. 15, FIG. 16). This reinforcement 117 is recessed in the area of the desired constriction 31. Thus, the reinforcement 117 is only arranged in the area of the cover 13 which is firmly connected with supports.

The ratio of a length 114, 116, 117, 118, for example 2 mm, preferably the plate width of a section 14, 16, 17, 18, to the distance a106 of the lateral faces 103, 104 of the groove 106 is preferably greater than 10. The distance a106 is always less than the constriction 31.

The individual sections 14, 16, 17, 18 of each cylinder 1 in accordance with the invention preferably have exterior diameters of the same size, and their surface area 8 is seated concentrically in respect to an axis of rotation of the cylinder 1.

In a first operating mode, the cylinder in accordance with the invention is reversibly divided into at least two adjacent cylinder-shaped sections 14, 16, 17, 18 by at least one circulating ring-shaped depression, i.e. the constriction 31). In a second operating mode, this constriction 31 is relaxed for forming a functionally uninterrupted surface area 8.

What is claimed is:

1. A cylinder (1) for a rotary printing press, whose barrel (6) has an at least partial uninterrupted surface area (8) of a rubber-elastic cover (13), characterized in that this surface area (8) can be selectively divided by means of a ring-shaped constriction (31), whose diameter can be reversibly reduced, of the cover (13).

2. The cylinder (1) in accordance with claim 1, characterized in that adjusting means (61, 73, 87), are provided, which act in the radial direction on the cover.

3. The cylinder (1) in accordance with claim 1, characterized in that adjusting means (97, 99), are provided, which act in the axial direction on the cover.

4. The cylinder (1) in accordance with claim 2, characterized in that adjusting means (61, 73, 97) are provided, which press radially outward on the inside (32) of the cover (13) and relax the constriction (31).

5. The cylinder (1) in accordance with claim 3, characterized in that the cylinder (1) has cylinder-shaped supports (97, 99) for the cover (13), which can be axially displaced in relation to each other, that the supports (97, 99), forming a circulating groove (106), are adjacent to each other at a variable distance (a106), that the cover (13) is firmly connected with the supports (97, 99), that the cover (13) is arranged so that it can be stretched, or respectively compressed, in the area of the groove (106).

6. The cylinder (1) in accordance with claim 5, characterized in that support elements (102, 113, 114, 117) are arranged in the area of the constriction (31).

7. The cylinder (1) in accordance with claim 5, characterized in that an accumulation (108) of the rubber-elastic material is provided in the area of the constriction (31).

8. The cylinder (1) in accordance with claim 1, characterized in that ratio of a length of a cylinder-shaped section (14, 16, 17, 18), divided by the constriction (31), of the barrel (6), to the width of the constriction (31) is greater than 10.

9. The cylinder (1) in accordance with claim 2, characterized in that the inside (32) of the cover (13) is connected with segments (61, 142) of a support ring (62), and that these segments (61, 142) are arranged to be radially movable.

10. The cylinder (1) in accordance with claim 9, characterized in that a plurality of segments (142) is arranged in the axial direction).

11. The cylinder (1) in accordance with claim 9, characterized in that the segments (61) can be pneumatically moved.

12. The cylinder (1) in accordance with claim 2, characterized in that the inside (32) of the cover (13) is connected with a hose (86), which can be charged with a pressure medium.

13. The cylinder (1) in accordance with claim 2, characterized in that the inside (32) of the cover (13) can be directly or indirectly acted upon by a vacuum.

14. The cylinder (1) in accordance with claim 1, characterized in that the cylinder (1) is designed as an application cylinder, which cooperates with a printing cylinder.

15. The cylinder (1) in accordance with claim 1, characterized in that the rubber-elastic cover (13) does not have a reinforcement (117) in the area of the constriction (31) and outside the area of the constriction does have a reinforcement (117).

16. The cylinder in accordance with claim 8, characterized in that the supports (97, 99) are arranged so they cooperate with collars (101, 102), which radially engage the cover (13) in the direction toward the exterior.

17. A method for dividing a cylinder (1), whose barrel (6) has an at least partial uninterrupted surface area (8) of a rubber-elastic cover (13), characterized in that this surface area (8) can be selectively divided by means of a ring-shaped constriction (31), whose diameter can be reversibly reduced, of the cover (13).

18. The method in accordance with claim 17, characterized in that the constriction (31) is created, or respectively relaxed, by means of forces acting radially on the cover.

19. The method in accordance with claim 17, characterized in that the constriction (31) is created, or respectively relaxed, by means of forces acting axially on the cover (13).

20. The method in accordance with claim 19, characterized in that the constriction (31) is relaxed by means of forces, which compress the cover (13) in the axial direction.

21. The method in accordance with claim 19, characterized in that the constriction (31) is created by means of forces, which stretch the cover (13) in the axial direction.

22. A method for producing a cylinder (1) with a rubber-elastic cover (13), wherein initially supports (97, 99) are coated with the rubber-elastic cover (13), characterized in that subsequently the rubber-elastic cover (13) is deformed in such a way that a ring-shaped bead (111) is created on the surface area (8) of the cover (13), that then the cover (13) is worked in this state and the bead (111) is removed during this process, so that a continuous surface area (8) of equal diameter is created.

23. The method in accordance with claim 22, characterized in that the rubber-elastic cover (13) is compressed for creating the bead (111).

24. The method in accordance with claim 22, characterized in that the rubber-elastic cover (13) is radially arched from the inside for creating the bead (111).

* * * * *